US006289518B1

(12) United States Patent
O'Connor

(10) Patent No.: US 6,289,518 B1
(45) Date of Patent: Sep. 18, 2001

(54) GARMENT BELT AND METHOD OF MAKING THE SAME

(75) Inventor: Thomas B. O'Connor, Stratford, CT (US)

(73) Assignee: Reborn Products Co., Inc., Bensalem, PA (US)

( * ) Notice: Subject to any disclaimer, the term of this patent is extended or adjusted under 35 U.S.C. 154(b) by 0 days.

(21) Appl. No.: 09/593,619

(22) Filed: Jun. 13, 2000

(51) Int. Cl.[7] ..... A41F 3/02
(52) U.S. Cl. ..... 2/338; 2/311
(58) Field of Search ..... 2/338, 336, 170, 2/171, 311–312, 243.1, DIG. 11; 69/9, 21; 428/198, 105, 151, 904, 224; 156/79, 249; 264/225; 83/875, 870

(56) References Cited

U.S. PATENT DOCUMENTS

| | | | | |
|---|---|---|---|---|
| 1,799,868 | * | 4/1931 | Sauer | 2/338 |
| 2,396,329 | * | 3/1946 | Lippmann | 2/338 |
| 3,908,571 | * | 9/1975 | Motsenbocker | 2/338 |
| 4,110,139 | * | 8/1978 | Mashida et al. | 2/311 |
| 5,517,697 | * | 5/1996 | Boehm | 2/338 |

* cited by examiner

*Primary Examiner*—John J. Calvert
*Assistant Examiner*—Tejash Patel
(74) *Attorney, Agent, or Firm*—Caesar, Rivise, Bernstein, Cohen & Pokotilow, Ltd.

(57) ABSTRACT

A garment belt and method of making it. The belt has a first end portion at which a buckle is mounted and a second end portion for engagement with the buckle when the belt is worn. The belt formed of a blank or elongated strap of a first flexible material, e.g., a relatively low-cost but aesthetically and tactily-pleasing material such as a high quality vinyl. The strap includes outer surface providing that aesthetically pleasing appearance, and an inner surface. A central longitudinal axis form a fold line and extends the length of the strap. A pair of strips of leather are fixedly secured, e.g., adhesively bonded, onto the inner surface of said elongated strap and they extend parallel to and equidistantly spaced from each other on opposite sides of the fold line. One of the pair of strips has a recess, e.g., a transversely extending groove or a circular depression, located therein adjacent the first end portion of the belt. The other of the pair of strips has a projection extending therefrom located adjacent the first end portion of the belt and opposite to the recess. The projection, is shaped to mate with and be received in the recess. The, blank or strap is arranged to be folded over itself along the central longitudinally extending fold line, with the two leather strips confronting and abutting each other, and with the projection of one strip being received in the recess of the other so that the marginal edges of the strap are axially aligned. The confronting portions of the strap are adhesively secured to each other to hold the strap together with the leather strips interposed therebetween. The leather strips are of a reduced thickness at the first end portion of the belt to facilitate the folding of the strap thereat to mount the belt's buckle.

21 Claims, 3 Drawing Sheets

GARMENT BELT AND METHOD OF MAKING THE SAME

FIELD OF THE INVENTION

This invention relates generally to articles of apparel, and particularly to garment belts and methods of making such belts.

BACKGROUND OF THE INVENTION

Heretofore the manufacture of garment belts on a mass production basis has typically involved cutting leather or other flexible material into straps, forming the straps in the desired shape, and mounting a buckle thereon. One of the most common and highly sought after materials for making garment belts are animal hides, e.g., cowhide, a relative expensive base material. In order to keep costs down, while still providing the appearance of an expensive leather belt and the ability to label it as a leather belt, the belt may be fabricated of a high quality elongated strap of man-made material, e.g., vinyl or polyurethane, having an aesthetically pleasing appearance, e.g., one that replicates fine leather. The inside surface of the strap includes one or more strips of leather secured thereto on opposite sides of a longitudinal center-line of the strap, whereupon the top surface of the strip(s) form a portion of the inner surface of the strap. An adhesive, e.g., a water-based latex, is applied over any exposed portions of the entire inner surface of the strap and over the entire top surface of the leather strip(s). The strap, with the strip(s) secured is then folded over itself along its longitudinal center-line so that the longitudinal marginal edges of the strap are aligned with and abut each other to form a belt whose inner and outer surfaces are the outer surface of the strap, and with the leather strip(s) interposed therebetween and forming a core for the belt. A buckle is then typically mounted on one end portion of the belt by folding the buckle-forming end of the belt over itself and mounting the buckle at that folded end. Since the folding over of this end portion of the belt naturally increases the belt thickness to double its normal thickness, the folded over portion may be thinned down or "skived" by any conventional machine.

While the foregoing techniques for making belts and the belts produced thereby can present a quite aesthetically pleasing appearance and a good "hand-feel" (the belt feels rich and supple when held by a person), they still leave something to be desired from the standpoint of ease of manufacture, consistency of the resulting belts, and aesthetic appearance. For example, when the strap is folded over along its central longitudinal fold line, the two portions of the strap extending along either side of the fold line may not be precisely aligned so that their marginal edges do not perfectly overlie each other. Such a misalignment will naturally detract from the fine appearance the belt is desired to exhibit. Moreover, when the buckle forming end of the belt is folded over to mount the buckle, the folded over portion may have to be reduced in thickness, e.g., cut-away or skived, to prevent that end portion of the belt from being unsightly or uncomfortable.

Accordingly, a need exists for a garment belt and method of making the same that overcomes those disadvantages of the prior art.

OBJECTS OF THE INVENTION

It is therefore an object of this invention to provide a garment belt and method of making the same that overcomes those disadvantages of the prior art.

It is another object of this invention to provide a garment belt which can be manufactured readily.

It is another object of this invention to provide a garment belt which can be manufactured readily and relatively for some less expensive components, but which exhibits the visual aesthetics and hand feel of more expensive belts, e.g., hand made leather belts.

It is another object of this invention to provide a garment belt which, due to its internal construction, can be mass manufactured with a high degree of consistency from belt to belt.

It is another object of this invention to provide a garment belt which, due to its internal construction, is arranged to facilitate the mounting of a buckle thereon.

It is another object of this invention to provide a garment belt which can be manufactured readily from less expensive components, but which exhibit the visual aesthetics and hand feel of belts fabricated of more expensive components.

It is another object of this invention to provide a method for mass producing a garment belts with a high degree of consistency from belt to belt.

It is another object of this invention to provide a simple, reliable, and relatively inexpensive method of manufacturing a garment belt having a buckle mounted thereon.

SUMMARY OF THE INVENTION

These and other objects of this invention are accomplished by providing a blank for making a garment belt therefrom. The garment belt has a first end portion for mounting a buckle thereon. The blank comprising an elongated strap of a first flexible material, e.g., high-quality vinyl, having an outer surface and an inner surface, and a central longitudinal axis forming a fold line. A pair of strips of leather are fixedly secured onto the inner surface of the elongated strap and extend parallel to and equidistantly spaced from each other on opposite sides of the fold line.

One of the pair of leather strips has a recess, e.g., a transversely extending elongated groove, a circular depression, etc., located therein adjacent the first end portion of the strap. The other of the pair of leather strips has a projection extending therefrom located adjacent the first end portion and opposite the recess. In accordance with one preferred aspect of the invention the projection is shaped to mate with and be received in the recess in the opposed leather strip (e.g., to effectively form a "tongue and groove" mating connection).

The blank of material is arranged to be folded over itself along its fold line, whereupon the two leather strips on its inner surface confront and abut each other, with the projection of one leather strip being received in the recess of the other so that the marginal edges of the strap are axially aligned, e.g., prevent any lateral shifting or misalignment of the two folded portions of the strap (which would detract from the appearance of the belt and destroy its "high quality" look.

In accordance with another aspect of this invention the leather strips are formed of a reduced thickness at the portion of the strap at which the belts buckle is to be mounted, thereby enabling that portion of the belt to be folded around a portion of the buckle to hold the buckle in place and without resulting in an excessively thick portion of the belt at that mounting point.

DESCRIPTION OF THE DRAWINGS

Other objects and many of the attendant advantages of this invention will become readily appreciated as the same becomes better understood by reference to the following detailed description, when considered in connection with the accompanying drawing, wherein.

DETAILED DESCRIPTION OF THE PREFERRED EMBODIMENT

Figure 1:
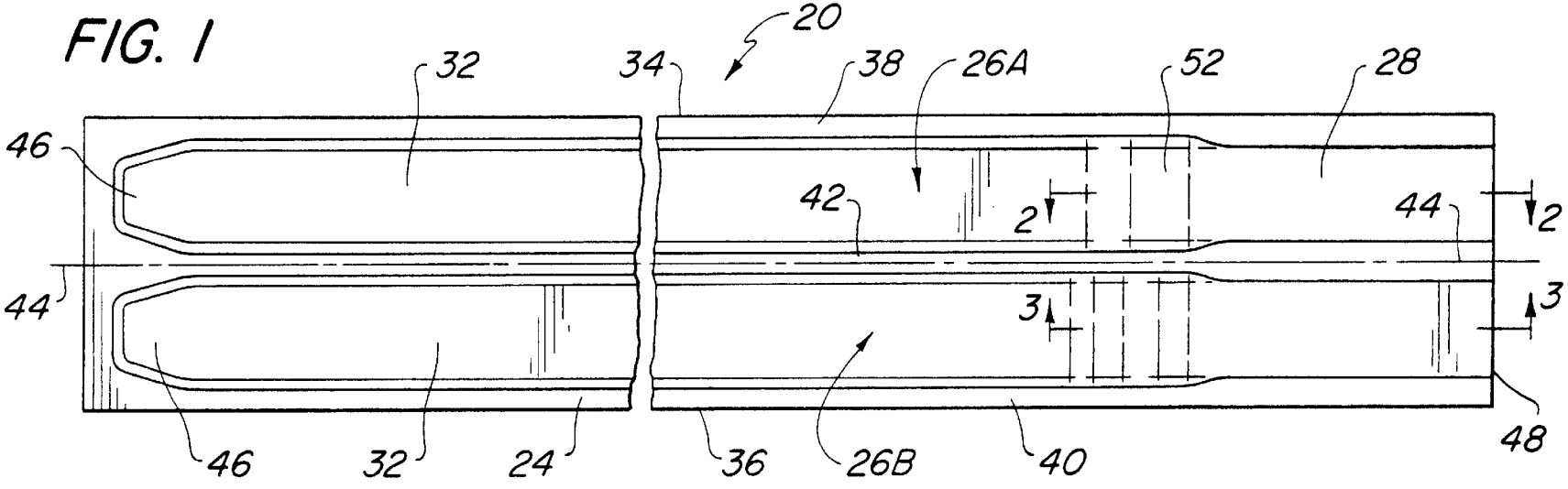
FIG. 1 is a top plan view of the inside surface of a belt blank constructed in accordance with this invention for forming a belt, with the belt blank being shown at an early point in the manufacture of the belt.
Figure 2:
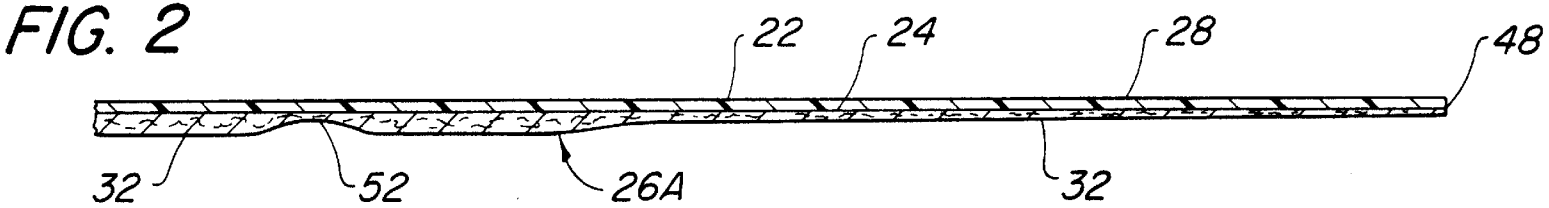
FIG. 2 is an enlarged sectional view taken along line 2—2 of FIG. 1.

Referring now in greater detail to the various figures of the drawing, wherein like reference characters refer to like parts, there is shown generally at 20 in FIG. 1 one embodiment of a blank 20 for forming a garment belt 10 (FIG. 8) in accordance with one aspect of this invention. The details of the blank 20 will be discussed shortly. Suffice it for now to state that the blank 20 is formed of a relatively inexpensive outer or cover-stock material that has an aesthetically pleasing outer surface 22 (FIG. 2) and an inner surface 24 to which two elongated insert or filler strips, 26A and 26B, are secured. The blank 20 is initially formed by laminating a strip of inexpensive leather, e.g., split cowhide, on the inner surface 24 of the cover-stock. Then the laminated body is shaped, e.g., the leather layer skived by a conventional skiving machine (not shown), and the resulting skived blank assembled, e.g., folded along a central longitudinal axis (to be described later) and glued so that the skived filler strips 26A and 26B form a leather core within the man-made outer cover, to produce an aesthetically pleasing, yet relatively low cost garment belt 10 shown in FIG. 8.

Figure 8:
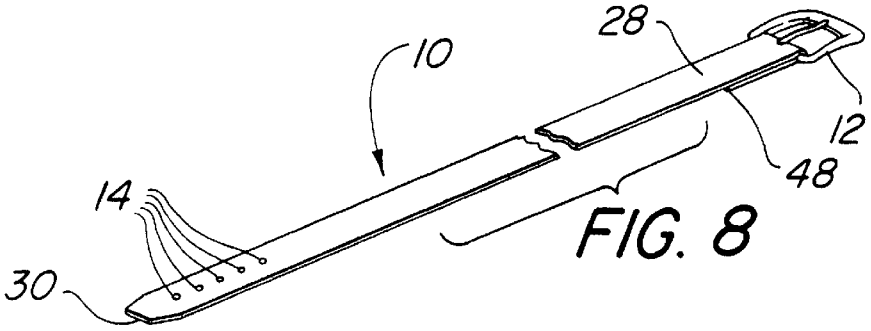
FIG. 8 is a reduced isometric view of a finished belt constructed in accordance with this invention and formed by the method of this invention.

As best seen in FIG. 8 the garment belt 10 has a first end portion 28 to which any type of conventional buckle 12 is attached. The other free end of the belt is designated by the reference number 30 and is of conventional shape, e.g., a tapered free end. As is conventional, the free end 30 of the belt also includes plural holes 14 equidistantly spaced on the belt's central longitudinal axis adjacent the free end 30 for cooperating with the buckle 12 to hold the belt in place on the wearer's waist.

Notwithstanding the fact that the outer surface of the belt is formed of a relatively low cost, man-made material, owing to the construction of the blank, e.g., the use of plural strips of genuine leather as the filler or core, once the belt 10 is assembled it will have the feel and visual appearance of a fine quality, e.g., hand finished, all-leather belt. Moreover, since the insert of the belt is, in fact, leather, the belt may be properly referred to as a "genuine leather" belt. Further still, as will be described in considerable detail later, the leather insert strips are constructed to include alignment means, e.g., each strip includes a mating portion which is arranged to cooperate with the mating portion of the other strip to hold the folded portions of the belt in proper alignment, so that the marginal edges of the belt are precisely aligned and straight.

Turning now to FIG. 1 there is shown a plan view of one embodiment of a blank 20 constructed in accordance with this invention. As can be seen therein the blank 20 basically consists of an elongated strap of any suitable cover-stock material for making up the outer (visible) surface of the belt. In accordance with one preferred embodiment the blank 20 is formed of a relatively inexpensive cover-stock material, e.g., vinyl or polyurethane, that never the less exhibits an aesthetically pleasing outer surface 22 and a supple, rich feel. It should be pointed out at this juncture that the cover-stock of the blank 20 need not be formed of a man-made material. Thus, if desired it may be formed of fine tanned leather or other animal skin, instead of a man-made material, but still using the relatively lower cost filler strips 26A and 26B to form the core for the belt. Moreover, depending upon the type of belt desired, for some applications the filler strips 26A and 26B may be formed of an suitable man-made material, instead of leather. In other applications, the filler strips may be formed of a higher grade leather or other animal hide, than split cowhide.

Irrespective of the composition of the laminated blank 20, the strips 24A and 24B are preferably formed in-situ on the inner surface 24 of the blank. In particular, in the exemplary embodiment discussed heretofore the laminated blank consists of the vinyl or polyurethane cover-stock on which a layer of any suitable type of leather, e.g., inexpensive split cowhide, which is coextensive in width and length with the strap 20 is adhesively secured. The top surface of the leather layer of the strap or web is denoted by the reference number 32. The laminated strap or web is then passed through any suitable type of skiving or shaving machine to remove the entire thickness of the leather layer along the longitudinal marginal edges 34 and 36 of the strap or web. This action forms a channel or groove 38 along the marginal edge 34 and a similar channel or groove 40 along the marginal edge 36. The skiving machine is also arranged to shave or skive away a central portion of the leather layer to form a third channel or groove 42 extending down the central longitudinal axis 44 of the strap or web 20. Moreover, the skiving machine's cutters may be shaped so that the leather strips 24A and 24B which are formed thereby each terminate in a truncated tapered free end 46 located immediately adjacent free end 30.

The marginal edges of the two strips 26A and 26B taper downward from the top surface 32 of the leather layer to the inner surface 24 of the cover-stock of the blank 20 where the leather had been removed, i.e., the portions forming the channels 38, 40 and 42, about virtually the entire of the periphery of those strips, except for the portions of those strips which are located at the end portion 28 of the blank. The leather strips 24A and 24B at the end portion of the blank are skived away during the skiving operation so that the top surface of the leather in those areas is closer to the inner surface 24 of the strap 20 than the top surface 32 of the remainder of the strips, i.e., the thickness of the strips 26A and 26B in the area of the end portion 28 of the belt up to the free end 48 is less than the thickness in the remaining areas of the strips. This feature ensures that when the blank 20 is folded in half along its longitudinal central axis 44 and adhesively secured (as will be described later), the end portion 28 of the belt up to the free end 48 will be thinner that the remainder of the belt (for reasons to be described later).

Once the belt blank has been skived as just described any suitable type of adhesive, e.g., a water-based latex, is then applied over the entire inner surface of the blank, i.e., over the inner surface 24 of the cover-stock of the blank 20 which had been exposed by the removal of the leather layer, and over the entire exposed surface of the leather strips 26A and 26B. This adhesive is allowed to dry, so that it becomes self-adhering, i.e., it will adhere to itself.

The blank is now ready to be assembled into the belt. To achieve that end, the blank 20 is folded in half along its longitudinal central axis or fold line 44 so that its marginal edges 34 and 36 are colinear, with the strips 26A and 26B interposed between the folded cover-stock and confronting each other. The self-adhering nature of the latex adhesive on the confronting surfaces adhesively secures them together when they are brought into engagement with each other.

Figure 3:
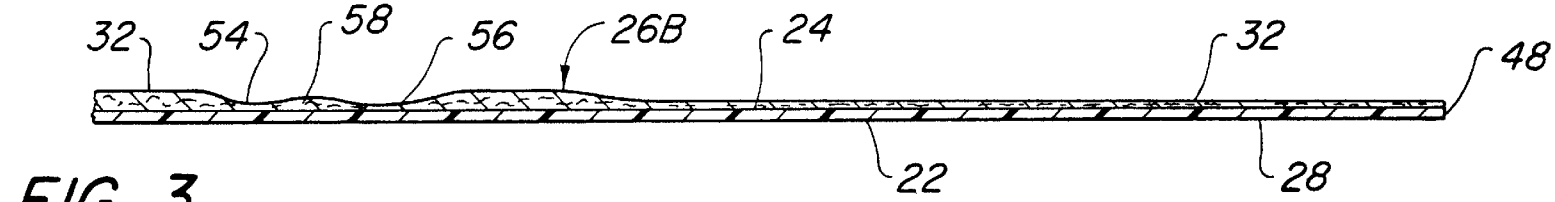
FIG. 3 is an enlarged sectional view taken along line 3—3 of FIG. 1.
Figure 4:
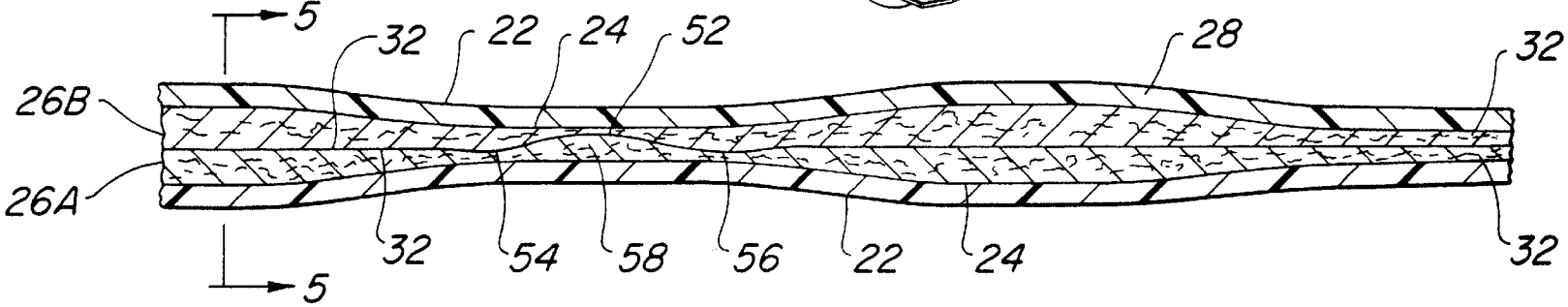
FIG. 4 is an enlarged sectional view of the buckle mounting end of the belt blank shown in FIG. 1 at a later point in the manufacture of the belt, i.e., after the belt blank has been assembled but prior to the mounting of the belt buckle thereon.
Figure 5:
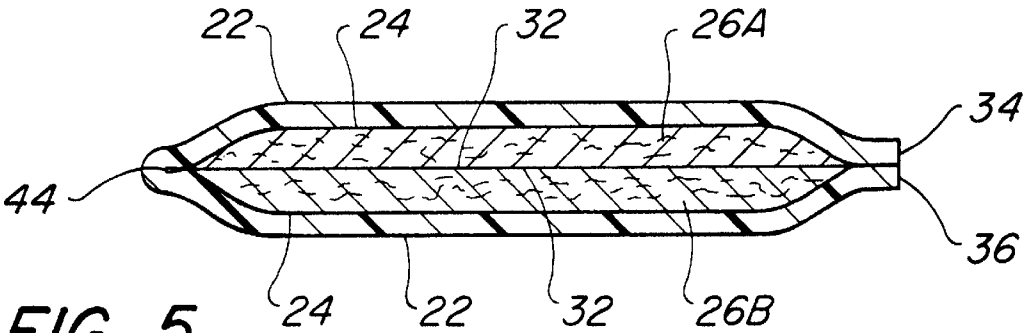
FIG. 5 is an enlarged sectional view taken along line 5—5 of FIG. 4.

In order to ensure that the two marginal edges of the belt do, in fact, align colinearly as they are being adhesively secured, the blank 20 includes the heretofore mentioned alignment means. In the exemplary embodiments shown and described herein that means basically comprises a pair of cooperating mating members arranged to engage each other and hold the confronting belt portions in the desired alignment. Those cooperating mating members can take various shapes and sizes in accordance with this invention, only two of which are shown herein. For example, in the embodiment shown in FIGS. 1–5 the strip 26A includes a transversely extending groove or recess 52 (see FIG. 2) in the strip closely adjacent the thinned portion of the strip in area 28. This groove is formed in the strip 26A during the heretofore described skiving operation or later. The strip 26B includes a pair of transversely extending grooves 54 and 56 to form a rounded transversely extending linear ridge 58 between them (see FIG. 3). The transversely extending grooves 54 and 56 and the linear ridge 58 between them of the strip 26B can be formed in that during the heretofore skiving operation or later. The ridge 58 in the strip is aligned with the groove or recess 52 in the strip 26A so that when the belt's blank is folded in half along its central longitudinal axis 44 the ridge 58 matingly fits within the groove 52 as best seen in FIG. 4. This mating fit effectively aligns the position of two strips together so that the marginal edges 34 and 36 of the blank 20 are coincident (as shown in FIG. 5) and colinear and the fold line 44 (the central longitudinal axis) is linear.

The folding in half of the belt blank 20 to adhesively secure the portions together as just described can be accomplished manually or by passing the blank through some apparatus which squeezes the confronting portions together. In any event, once the portions have been adhesively secured and squeezed together the portions of the belt contiguous with the fold taper together to form a neat and clean linear edge, as best seen in FIG. 5, while the portions of the belt contiguous with the abutting marginal edges 34 and 36 similarly taper together to form a neat and clean linear edge.

The formed belt is now ready to be processed further, e.g., the buckle 12 mounted thereon. The mounting of the buckle 12 on the belt can be accomplished in a conventional manner. For example, the free end 48 of the belt can be folded over itself transversely to the longitudinal axis 44 to form a pocket into which a portion of the buckle 12 is located, and once that has been accomplished the folded over portion at the free end is secured in place, e.g., sewn or glued. As mentioned earlier the thickness of the leather insert strips 26A and 26B in the area of the end portion 28 of the belt contiguous with the free end 48 is less than the thickness in the remaining areas of the insert strips. This feature ensures that when the blank 20 is folded in half along its longitudinal central axis 44 and adhesively secured as described above, the end portion 38 of the belt contiguous with the free end 48 will be thinner than the remainder of the belt. By so doing, when the end portion 28 contiguous with the free end 48 is folded over itself transversely to the longitudinal axis to mount the buckle 12 within the pocket formed by the fold, the double layer of the belt at this folded-over area will not be excessively thick or bulky (e.g., twice the thickness of the remaining portion of the belt), without requiring the skiving or removal of a portion of the thickness of the folded over free end portion 48. Any additional processing of the belt, e.g., the formation of the plural holes for cooperation with the buckle, can be accomplished either before the mounting of the buckle or after it.

Figure 6:
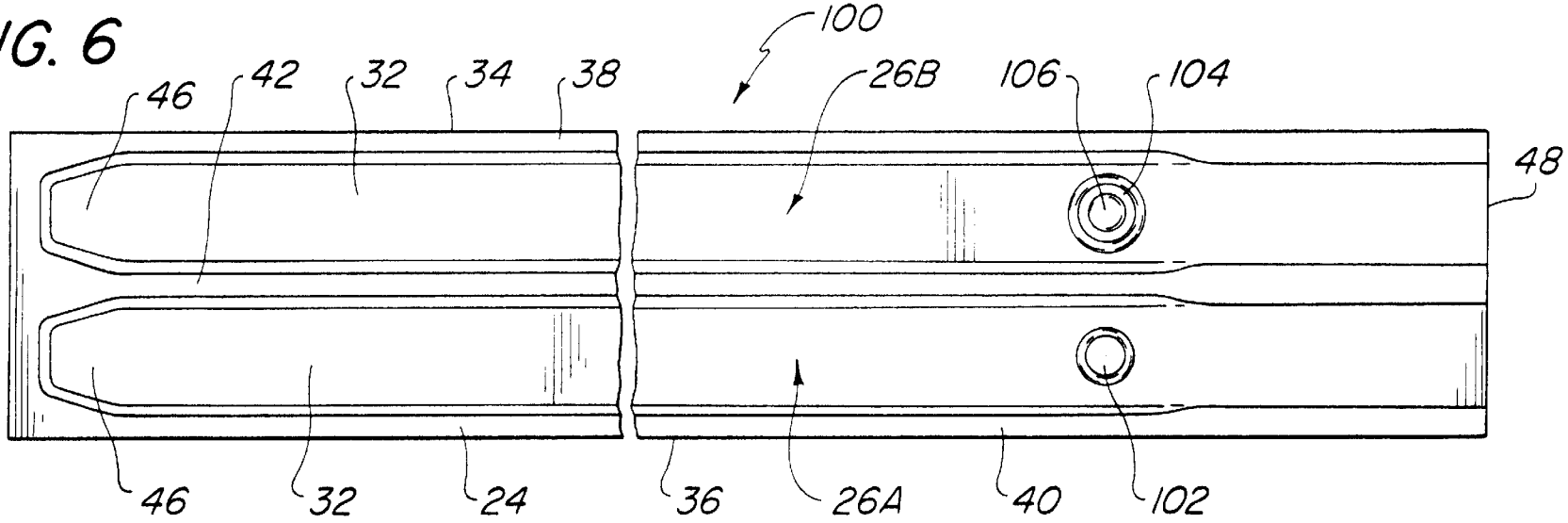
FIG. 6 is a top plan view of the inside surface of an alternative embodiment of a belt blank constructed in accordance with this invention for forming a belt, with the belt blank being shown at an early point in the manufacture of the belt.
Figure 7:
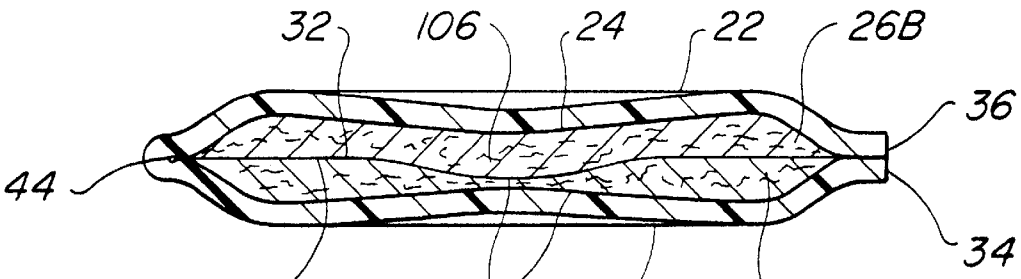
FIG. 7 is an enlarged sectional view similar to FIG. 5, but showing the embodiment of the belt blank shown in FIG. 6.

In FIGS. 6 and 7 there is shown an alternative embodiment 100 of a belt blank constructed in accordance with this invention. The blank 100 is in all respects identical to the blank 20 described heretofore with reference to FIG. 1, except that blank 100 makes use of different alignment means to ensure that the belt's edges 34 and 36 are colinear. In the interest of brevity the common components of the blanks 100 and 20 will be given the same reference numbers and their construction and operation will not be reiterated. Thus, as can be seen in FIGS. 6 and 7 the blank 100 includes a strip 26B having a circular shaped concave recess or cavity 102 located closely adjacent the thinned portion of the strip in area 28. This cavity or recess 102 can be formed in the strip 26B during its skiving operation or later. The strip 26A includes an annular recess 104 extending about an upstanding dome-shaped projection 106 that is aligned with the cavity or recess 102 in the strip 26B so that when the belt's blank is folded in half along its central longitudinal axis the dome-shaped projection 106 matingly fits within the recess or cavity 102 as best seen in FIG. 7. This mating fit effectively aligns the position of two strips together in the same manner as described heretofore so that the marginal edges 34 and 36 of the blank are coincident and colinear and the fold line (the central longitudinal axis) is linear.

As should be appreciated from the foregoing belts constructed in accordance with subject invention can be manufactured easily and at a relatively low cost, yet provide the aesthetically pleasing appearance of more expensive belts.

Without further elaboration, the foregoing will so fully illustrate my invention that others may, by applying current or future knowledge, readily adapt the same for use under various conditions of service.

I claim:

1. A blank for making a garment belt therefrom, said garment belt having a first end portion for mounting a buckle thereon, said blank comprising an elongated strap of a first flexible material having an outer surface and an inner surface, a central longitudinal axis forming a fold line, a pair of strips of leather fixedly secured onto said inner surface of said elongated strap and extending parallel to and equidistantly spaced from each other on opposite sides of said fold line, one of said pair of strips having a recess therein located adjacent said first end portion, the other of said pair of strips having a projection extending therefrom located adjacent said first end portion and opposite said recess, said projection being shaped to mate with and be received in said recess, said blank being arranged to be folded along said fold line, whereupon said strips are confront and abut each other with said projection being received in said recess.

2. The blank of claim 1 additionally comprising an adhesive layer disposed over said strips and said inner surface of said strap for securing said portions of said strap to each other when said strap is folded along said fold line.

3. The blank of claim 1 wherein each of said strips is of a substantially constant thickness along substantially the length thereof, but terminating in reduced thickness end portion forming said buckle-mounting end portion of said belt.

4. The blank of claim 1 wherein said recess comprises an elongated channel extending transversely to said fold line.

5. The blank of claim 1 wherein said recess comprises a circular cavity.

6. The blank of claim 1 wherein each of said strips includes a marginal edge, said marginal edges being tapered to merge with said inner surface of said strap.

7. The blank of claim 1 wherein said first flexible material is man-made.

8. The blank of claim 7 wherein said first flexible material is vinyl.

9. The blank of claim 1 wherein each of said strap includes a pair of marginal edge, said marginal edges being arranged to be adhesively secured together by said adhesive layer when said strap is folded along said fold line.

10. A garment belt having a first end portion at which a buckle is mounted and a second end portion for engagement with said buckle when said garment belt is in place on the waist of a wearer, said belt being formed of an elongated strap of a first flexible material having an outer surface and an inner surface, a central longitudinal axis forming a fold line, a pair of strips of leather fixedly secured onto said inner surface of said elongated strap and extending parallel to and equidistantly spaced from each other on opposite sides of said fold line, one of said pair of strips having a recess therein located adjacent said first end portion, the other of said pair of strips having a projection extending therefrom located adjacent said first end portion and opposite said recess, said projection being shaped to mate with and be received in said recess, said blank being arranged to be folded along said fold line, with said strips confronting and abutting each other, with said projection being received in said recess and with said confronting portions being adhesively secured to each other.

11. The belt of claim 10 wherein each of said strips is of a substantially constant thickness along substantially the length thereof, but terminating in reduced thickness end portion forming said buckle-mounting end portion of said belt.

12. The belt of claim 10 wherein said recess comprises an elongated channel extending transversely to said fold line.

13. The belt of claim 10 wherein said recess comprises a circular cavity.

14. The belt of claim 10 wherein each of said strips includes a marginal edge, said marginal edges being tapered to merge with said inner surface of said strap.

15. The belt of claim 10 wherein said first material is a man-made material.

16. The belt of claim 15 wherein said man-made material is vinyl.

17. A method of making garment belt having a first end portion at which a buckle is mounted and a second end portion for engagement with said buckle when said garment belt is in place on the waist of a wearer, said method comprising the steps of:

(A) providing an elongated strap of a first flexible material having an outer surface and an inner surface, and a central longitudinal axis forming a fold line;

(B) adhering a strip of leather onto said inner surface and cutting away portions of said leather strip to form a pair of leather strips secured onto said inner surface of said elongated strap and extending parallel to and equidistantly spaced from each other on opposite sides of said fold line;

(C) cutting away a portion in one of said pair of strips to form a recess therein located adjacent said first end portion; and (D) cutting away a portion in the other of said pair of strips to form a projection extending therefrom located adjacent said first end portion and opposite said recess, said projection being shaped to mate with and be received in said recess.

18. The method of claim 17 additionally comprising the step of:

(E) applying an adhesive layer over said strips and said inner surface of said strap; and (F) folding said blank along said fold line, with said strips confronting and abutting each other, with said projection being received in said recess and with said confronting portions being adhesively secured to each other by said adhesive layer.

19. The method of claim 18 additionally comprising the step of:

(G) cutting away portions of said leather strips adjacent said first end portion to form reduced thickness leather strip portions thereat.

20. The method of claim 18 wherein said recess comprises an elongated channel extending transversely to said fold line.

21. The method of claim 18 wherein said recess comprises a circular cavity.

* * * * *